US005976643A

United States Patent [19]

Sallee

[11] Patent Number: 5,976,643

[45] Date of Patent: Nov. 2, 1999

[54] LOW THERMAL SIGNATURE CAMOUFLAGE GARNISH

[75] Inventor: Bradley Sallee, Austin, Tex.

[73] Assignee: Marconi Aerospace Defense Systems, Inc., Austin, Tex.

[21] Appl. No.: 08/744,264

[22] Filed: Nov. 6, 1996

[51] Int. Cl.[6] ..... F41H 3/00

[52] U.S. Cl. ..... 428/17; 428/85; 428/919

[58] Field of Search ..... 428/15, 17, 919, 428/85

[56] References Cited

U.S. PATENT DOCUMENTS

| | | | |
|---|---|---|---|
| 2,351,142 | 6/1944 | Mitchell . | |
| 2,911,652 | 11/1959 | Ekman | 428/919 X |
| 3,069,796 | 12/1962 | Ruter . | |
| 4,106,124 | 8/1978 | Green | 428/919 X |
| 4,330,444 | 5/1982 | Pollman | 428/378 X |
| 4,495,239 | 1/1985 | Pusch et al. | 428/919 X |
| 4,529,633 | 7/1985 | Karlsson | 428/919 X |
| 4,615,921 | 10/1986 | Johansson | 428/919 X |
| 4,940,619 | 7/1990 | Smith et al. | 428/919 X |
| 5,010,589 | 4/1991 | Hamilton | 428/919 X |
| 5,153,045 | 10/1992 | Löfgren | 428/919 X |
| 5,274,848 | 1/1994 | Shamblin | 428/919 X |
| 5,281,460 | 1/1994 | Cox . | |
| 5,347,659 | 9/1994 | Tibljas | 428/919 X |

*Primary Examiner*—Henry F. Epstein

*Attorney, Agent, or Firm*—Locke Liddell & Sapp LLP

[57] ABSTRACT

The invention uses a garnish of tufts of filaments or strips attached to camouflage material, particularly camouflage material for use on mobile equipment, vehicles and personnel. The garnish or tuft is formed from a sheet of flexible, low emissivity material that has been cut into filaments or strips adhesively attached along one uncut longitudinal strip edge portion of the sheet. The tuft is formed by rolling the strip edge portion longitudinally around one part of a tuft retaining anchor, to form a rolled, adhesive-bound segment attached to the tuft part. When the rolled strips or filaments are so bound about the tuft retaining anchor part, a tuft is formed therefrom. When all the tuft retaining anchor parts are assembled, the tuft retaining anchor and tuft together constitute the garnish. A plurality of garnishes is attached to a base camouflage material on, e.g., mobile equipment, vehicles and personnel. The garnishes are preferably removably attached, to enable the color and other properties of the tuft to be varied in accordance with the surroundings in which the camouflage is to be effected. The tuft effectively absorbs and then dissipates heat by inducing air currents around the camouflaged object. The heat absorbed and dissipated otherwise would have been absorbed either by the base camouflage material or the device sought to be camouflaged, with a concomitant increase in the infrared signature of that device. This absorption and dissipation of heat is particularly effective when conditions of bright sunshine and calm or still conditions exist, especially in the early morning hours.

28 Claims, 6 Drawing Sheets

LOW THERMAL SIGNATURE CAMOUFLAGE GARNISH

STATEMENT ON FEDERALLY SPONSORED RESEARCH OR DEVELOPMENT

Not applicable

CROSS REFERENCE TO RELATED APPLICATIONS

Not applicable

BACKGROUND OF THE INVENTION

1. Field of the Invention

The field of the invention relates to camouflage materials, and more particularly to a new and improved camouflage material featuring a garnish for use with a base camouflage material, the combination providing camouflage with a low temperature rise even when exposed to bright sunlight under still conditions. The invention features a low thermal signature, particularly at wavelengths detected by infrared detectors designed to reveal camouflaged vehicles, equipment and personnel.

2. Description of the Prior Art

The use of camouflage materials to camouflage and thereby protect from detection vehicles and equipment is known in the prior art. However, the known camouflage materials suffer from various drawbacks and disadvantages. The known camouflage materials suffer variously from practicality, durability or temperature/infrared signature problems. Currently used systems generally either are durable but have a high temperature/infrared signature, or consist of a material such as a net suspended by standoffs over the vehicle or equipment, which has durability problems when used on a mobile vehicle. Other systems, such as that shown in U.S. Pat. No. 4,495,239, are for use in conjunction with other camouflaging materials and equipment, which increases the complexity and therefore decreases the practicality of use.

U.S. Pat. No. 4,106,124 discloses a combat helmet cover comprising a colored elastic or power net material with flexible grasslike strips which function as silhouette disrupter elements. The strips extend from a base which is sewn to a helmet cover. The dimensions of the strips vary irregularly, with the length of each strip being randomly selected. This helmet cover is not practical for use with large vehicles or equipment, and is only disclosed to have silhouette disrupter characteristics.

U.S. Pat. No. 5,281,460 discloses a camouflage covering including an underlying layer of lightweight porous material with a multiplicity of special fabric strips attached. The strips act as infrared signature and shape disrupters. The strips are said to be cooled by convection of the surrounding ambient air as a result of the ability of the strips to bunch, intertwine and fold. This camouflage covering suffers from the drawback that it comprises a lightweight porous material which would snag on bushes or other protruding objects.

U.S. Pat. No. 5,347,659 discloses a camouflage garment arranged to enclose an individual. The garment has a base web and a multitude of loop members formed of a camouflage material chosen to minimize reflection of light relative to the garment structure. This garment suffers from the drawback that both its loop members and the underlying web material would snag on bushes or other protruding objects.

BRIEF SUMMARY OF THE INVENTION

Although advances have been made in reducing the infrared signature of camouflaged vehicles and equipment, a continuing source of problems has been the inability of known camouflage materials to avoid a temperature rise and concomitant increased infrared signature when exposed to the combined conditions of bright sunlight and calm or still air. The problem occurs when a camouflaged object heats up under the influence of the bright sunlight, and the still air fails to dissipate the heat, as would be expected to happen under conditions of greater air movement. The heat absorbed is observed as an increased temperature and results in a greater infrared signature, and thus increases the possibility that the object sought to be camouflaged instead will be detected by apparatus sensitive to such infrared radiation. Air is a substance with a very low infrared emissivity, and therefore, a flow of air may be employed to carry away and dissipate heat from objects sought to be camouflaged, since the heat content of air is relatively difficult to detect, i.e., it has a low infrared emissivity. If an air flow can be induced around objects subjected to direct sunlight, the heat absorbed by the objects can be dissipated into the flowing air, and no noticeably increased infrared signature will be formed.

An object of the invention is to provide a camouflage material which affords protection against detection by thermal imaging apparatus, primarily in the infrared regions of the electromagnetic spectrum. The invention is of particular utility under still air or no wind conditions with bright sunlight, particularly in the early morning hours. This object is achieved by providing a camouflage material having attached garnishes or tufts which act to induce and promote air flow over and around the camouflage material and therefore avoid the buildup of heat and a concomitant infrared heat signature in the camouflage material, without reducing effective protection in the visible and other regions of the spectrum.

A further object of the invention is to provide a camouflage material having garnishes comprising tufts which are made of materials having variable shapes and colors. These tufts are interchangeable so as to provide controllably variable patterns of shape and color to the garnishes. This object is achieved by providing strips of selectively variable lengths and colors, which result in variable shapes and colors being imparted to the tufts. Tufts may be made of various materials having controllably variable emissivities, and different colors may be chosen so as to blend with different background environments.

The present invention provides a garnish which acts as an efficient air pump allowing a large flow of air to be induced adjacent the tuft of the garnish, thus resulting in a low temperature rise in the camouflage material, and a reduced infrared signature. The structure of the garnish allows for a simple manufacturing process to produce the garnish from simple materials, and results in a camouflage material that is free of structures giving rise to snags and tears during transport and movement of the vehicle or equipment sought to be camouflaged. The garnish or tuft is attached so as to resist being destroyed or forcibly stripped off the base camouflage material, even when equipment such as a tank is driven through a forest comprising up to 4 inch diameter pine trees. The shape of the tuft may be effectively adjusted, providing some degree of control over the airflow induced around the tufts. The structure of the tuft retaining anchor used for attaching the tuft to the base camouflage material allows the particular garnish used to be easily interchanged, allowing the user to adjust and compensate for variations in surrounding terrain.

These and other objects of the invention are achieved by the use of a garnish camouflage material which comprises tufts of filaments or strips approximately six to eight inches long and of various widths, but preferably about 1/16 to 1/8 inch in width, particularly useful as a garnish on standard camouflage material for use on mobile equipment and vehicles. The tuft is formed from a sheet of flexible, low emissivity material which has been cut into filaments or strips attached along an uncut longitudinal strip-like portion along one longitudinal edge of the sheet. The strip-like portion of uncut sheet material, to which the strips are attached, is treated with an adhesive material. The tuft is formed by rolling the sheet, preferably after cutting into strips, along the uncut strip-like edge portion longitudinally, so that the coiled sheet may be disposed between parts of a mandrel, to form a rolled, adhesive-bound segment attached to one or more parts of the tuft retaining anchor. When the rolled strips or filaments are so bound to the mandrel, a tuft is formed. When all the tuft retaining anchor are assembled, the tuft retaining anchor and tuft together constitute the garnish.

BRIEF DESCRIPTION OF THE DRAWINGS

FIG. 5 is a diagram of a tuft made from a sheet such as that shown in FIG. 2, while FIG. 6 is a diagram of a tuft made from a sheet such as that shown in FIG. 3 or 4.

DETAILED DESCRIPTION OF THE INVENTION

With reference now to the drawings, and in particular, to FIGS. 1 to 12, a new and improved camouflage material embodying the principles and concepts of the present invention will be described.

The garnish 10 of the present invention is made from sheets of a low infrared emissivity material such as Mylar, polyethylene, or the like. The preferred material is Mylar, and the most preferred is a metallized Mylar, which acts to reflect as much of the sun's energy as possible, and which has at the same time a low emissivity. A plurality of such garnishes 10 are contemplated to be used in a given application, as suggested in FIG. 1. The garnishes 10 are spaced so as to provide near-complete coverage of the outer surface of the base camouflage material 100.

Figure 1:
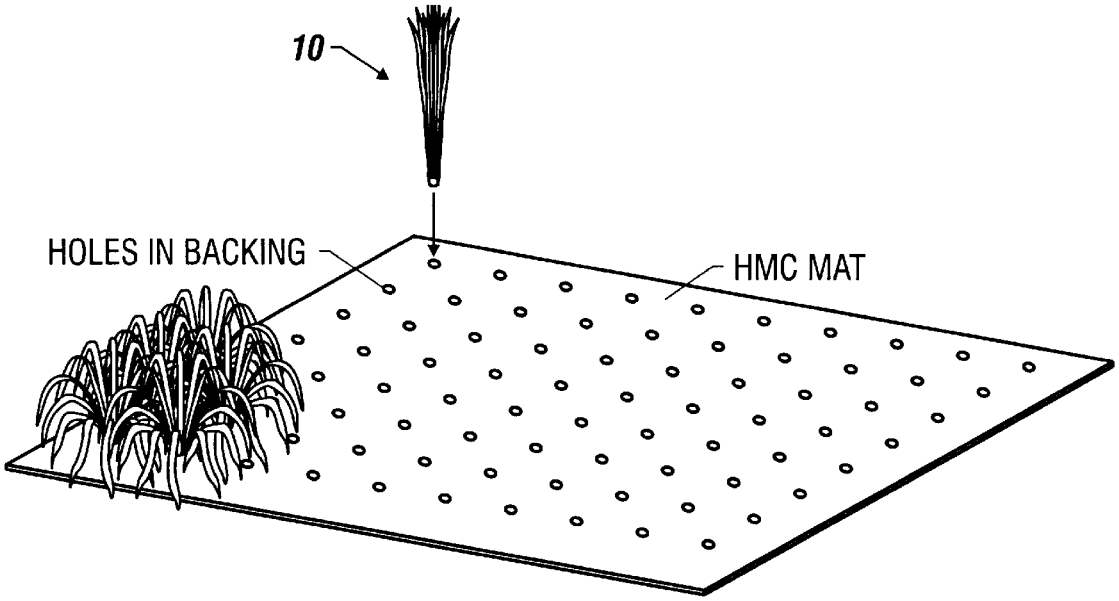
FIG. 1 is a schematic view of a camouflage material according to the invention, which can be used to camouflage a vehicle.
Figure 12:
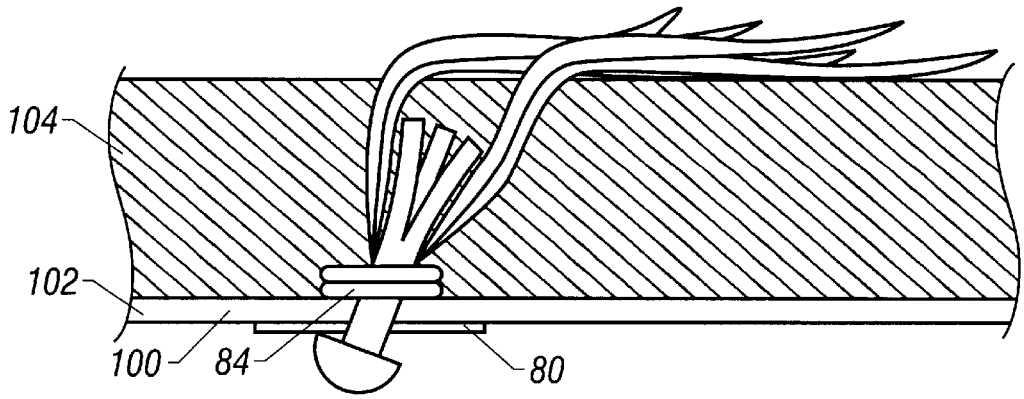
FIG. 12 is a schematic perspective view of a garnish attached to a base camouflage material in accordance with the present invention, undergoing a laterally applied "wipe-off" force.

As shown in FIGS. 1 and 12, the base camouflage material 100 is preferably an artificial mat-like surface mimicking the appearance of natural covering, such as an Astroturf(f) (HMC) material or the like (HMC) material having a relatively rigid plastic backing and a mat-like appearance formed by a plurality of grass-blade-like appendages 104 coated on the rigid plastic backing 102. The grass-blade-like appendages 104 are preferably approximately ¾ inch long, and may be in a random variety of variably bent orientations.

Figure 2:
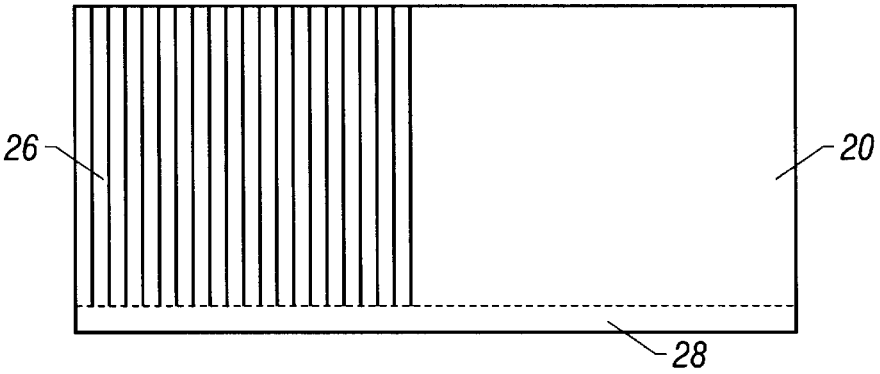
FIGS. 2, 3 and 4 are plan view schematics of sheets of flexible, low emissivity material having, respectively, a constant width, a straight but sloping longitudinal edge, and a parabolically curved longitudinal edge, in which each sheet has been cut into strips or filaments, according to the invention.
Figure 3:
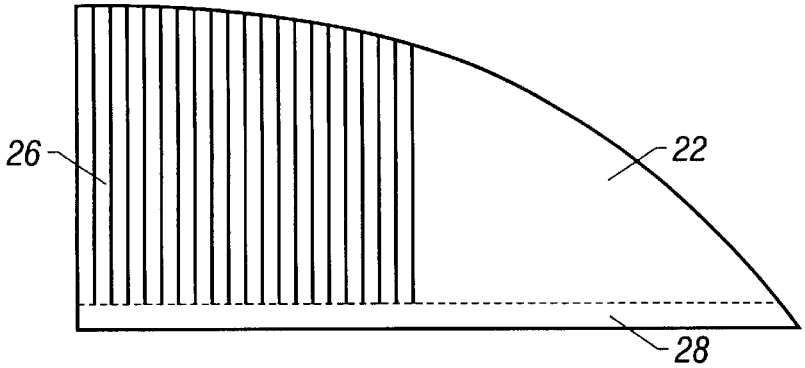
Figure 4:
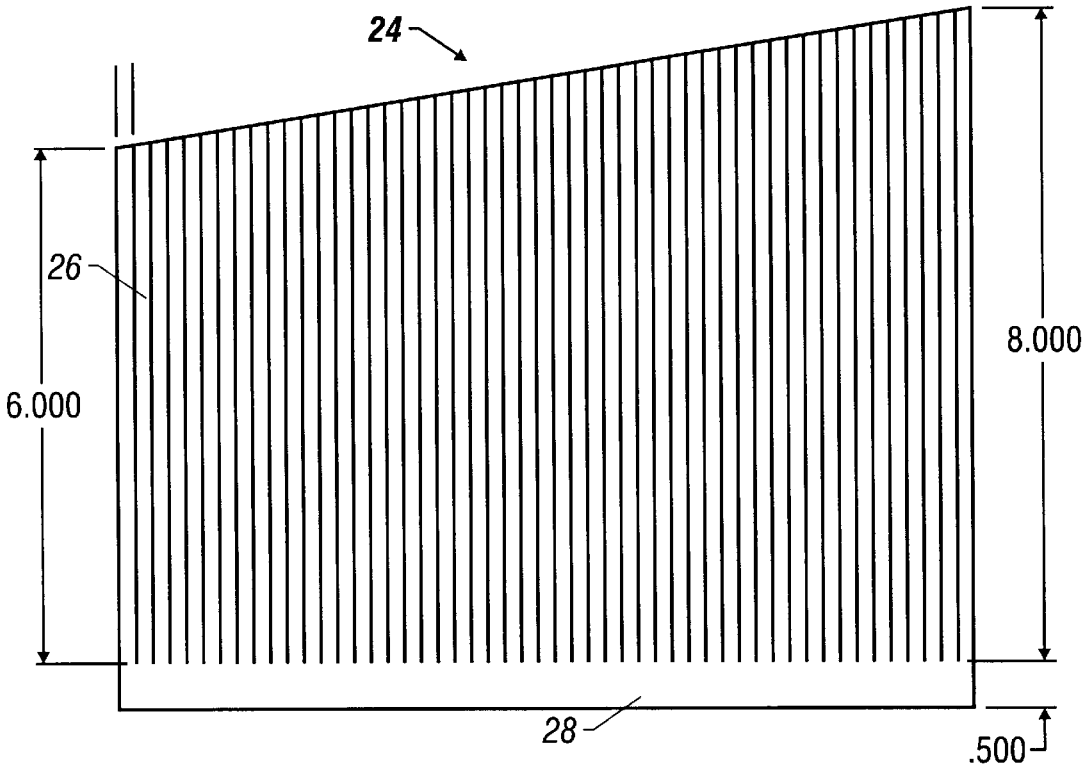

Referring now specifically to FIGS. 2, 3, and 4, to form the garnish 10 for the camouflage material of the invention, a sheet 20, 22, or 24, preferably of Mylar, having a longitudinal axis and a lateral axis, is cut into strips or filaments 26. The cuts preferably are made parallel to the lateral axis and perpendicular to the longitudinal axis of the sheet. The cuts preferably are made only partially across the sheet, so that a strip-like edge portion 28 of sheet material is left along one longitudinal axis of the sheet 20, 22, or 24. The cuts produce a plurality of strips or filaments 26 attached to the uncut strip-like portion 28 of the sheet 20, 22, or 24.

Preferably, the sheet used to form a single tuft, prior to cutting laterally, is approximately 6½ inches to 8½ inches wide, and approximately 9 inches long. The sheet may be generally rectangular (20 in FIG. 2), or may have one longitudinal edge that has various shapes. The variable longitudinal edge may be straight but sloping, i.e., defining an angled line (22 in FIG. 4); it may be curved, i.e., defining a curve such as a parabolic curve (24 in FIG. 3); or it may be irregular (not shown). As will be described in more detail below, the shape of the sheet influences the shape of the garnish 10 produced from that sheet as described herein. The lateral cuts produce strips or filaments 26 preferably in the approximate range of 1/8 inch to 1/16 inch wide, and preferably in the approximate range of 6 inches to 8 inches long. The uncut strip-like edge portion 28 of the sheet preferably is approximately ½ inch wide.

The strip-like edge portion 28 of the sheet 20, 22, or 24 preferably is treated with an adhesive material either before or after the cutting operation, depending on the manufacturing process used to produce the tufts. The preferred adhesive is a transfer adhesive. The adhesive-treated strip-like portion 28 is rolled snugly around an inner retaining rivet 40, a part of the tuft retaining anchor, such as a mandrel to be further described below. When the strip-like portion 28 is wrapped around the inner rivet 40 the tuft is formed, and when the remaining parts of the tuft retaining anchor are assembled therewith, the garnish 10 of the invention is formed. In the garnish, the filaments or strips 26 will be splayed outwardly partially by an outwardly tapering surface on the inner wall 54 of a retaining collar 50 and partially by their own weight and resilience.

Figure 5:
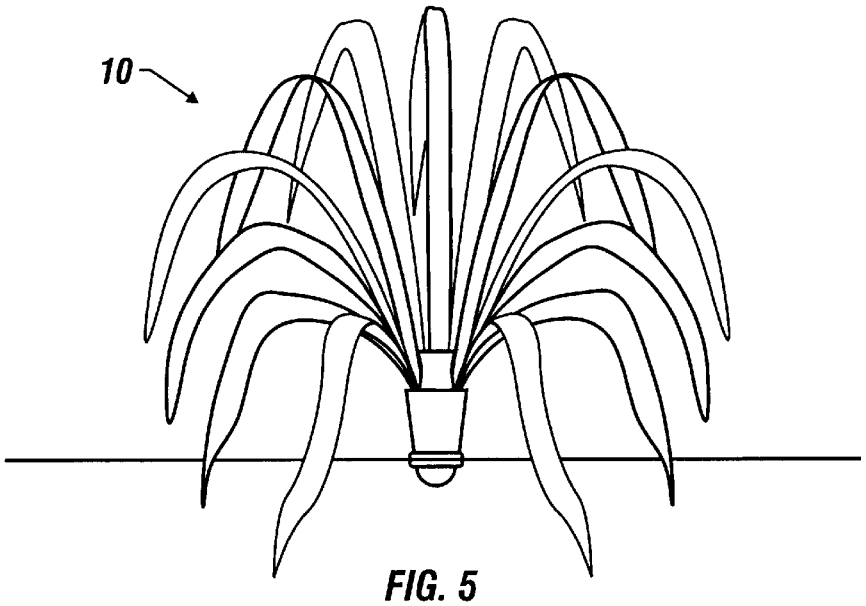
FIGS. 5 and 6 are perspective view schematic diagrams of tufts made according to the invention.
Figure 6:
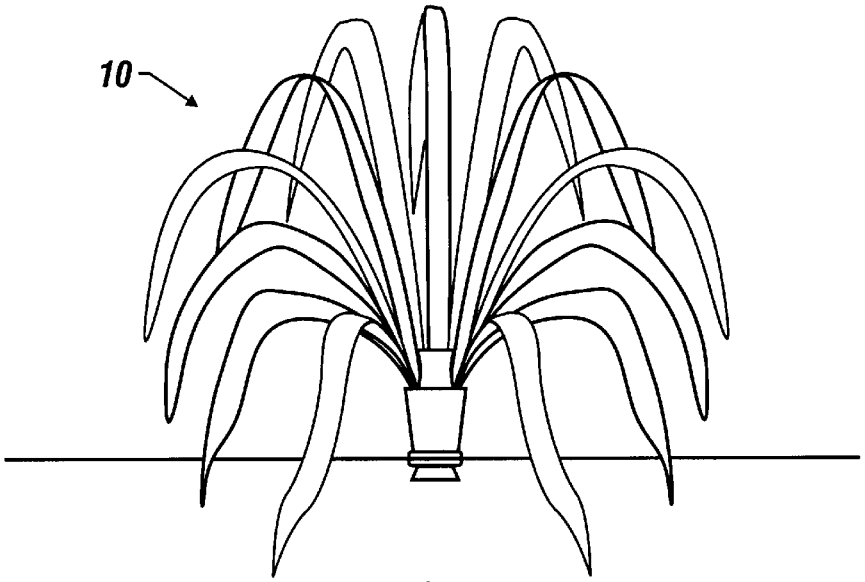

The shape of the tuft influences the flow characteristics of the air surrounding the camouflage material, and thereby the infrared signature of the camouflage material and the camouflaged vehicle or equipment. The shape of the tuft may be effectively selected by adjusting the length of the strips forming the tuft, preferably by adjusting the shape of the sheet. The exact shape of the garnish 10 is determined by the shape of the sheet 20, 22, or 24 from which the filaments or strips 26 were cut. For example, as shown in FIGS. 2 and 5, with a rectangular sheet 20, all the filaments or strips 26 will have substantially the same length, so that when wrapped around the inner rivet 40 and installed, the resulting garnish 10 will contain filaments or strips 26 all falling to substantially the same angle, since all have the same length and weight. In contrast, as shown for example in FIGS. 3 and 6, a garnish 10 formed from a sheet 24 having a parabolic curve along one longitudinal edge, will have filaments or strips 26 of lengths that vary from short to long. The tuft 10 formed from this sheet 24 will contain filaments or strips 26 falling in an even distribution of angles, from obtuse to acute. As another example, as shown in FIG. 4, a tuft formed from a sheet 22 having a straight but sloped longitudinal edge will have filaments or strips 26 of lengths that also vary from short to long, but the tuft formed will have a different distribution of angles and therefore a different overall shape than tufts made from a sheet having a parabolically curved longitudinal edge.

The color and emissivity of the garnish, as used on a given vehicle or equipment, may be altered by employing a tuft retaining anchor which can be removed and replaced by another tuft retaining anchor carrying a tuft of a different color or material. This is effectively accomplished by using a mandrel having a removable attachment, as discussed below. The garnish material includes materials having different visual and/or infrared colors to allow selection of such colors match the different background colors which may surround the vehicle or object to be camouflaged. Visible color means the visually observable color of the tuft or base camouflage material. Infrared color means the infrared signature produced by a given material under given conditions. Both the visual and the infrared colors of the tufts of the garnish may be selected as needed to match or approximate the background visual and infrared colors. The interchangeability of the garnish of the present invention provides and enhances this capability.

A tuft retaining anchor, such as a mandrel is provided for attaching the tuft to the base camouflage material 100, in accordance with the invention. The tuft retaining anchor includes a device for maintaining attachment of the garnish 10 to the base camouflage material 100 and assists in holding the uncut strip-like edge portion 28 of the tuft in position on the surface 48 of the inner barb 40 of the tuft retaining anchor. The attachment to the base camouflage material 100 may be permanent, or, more preferably, releasable and reattachable, allowing removal and replacement of the garnishes of the invention. While various known means of permanent attachment are applicable and could be used, a description of the preferred removable and reattachable taft retaining anchor is provided hereinbelow.

Figure 8A:
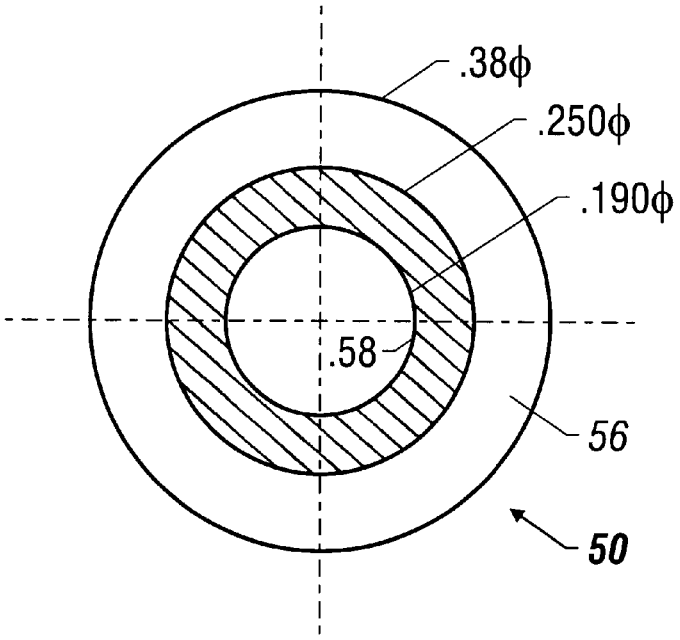
Figure 8B:
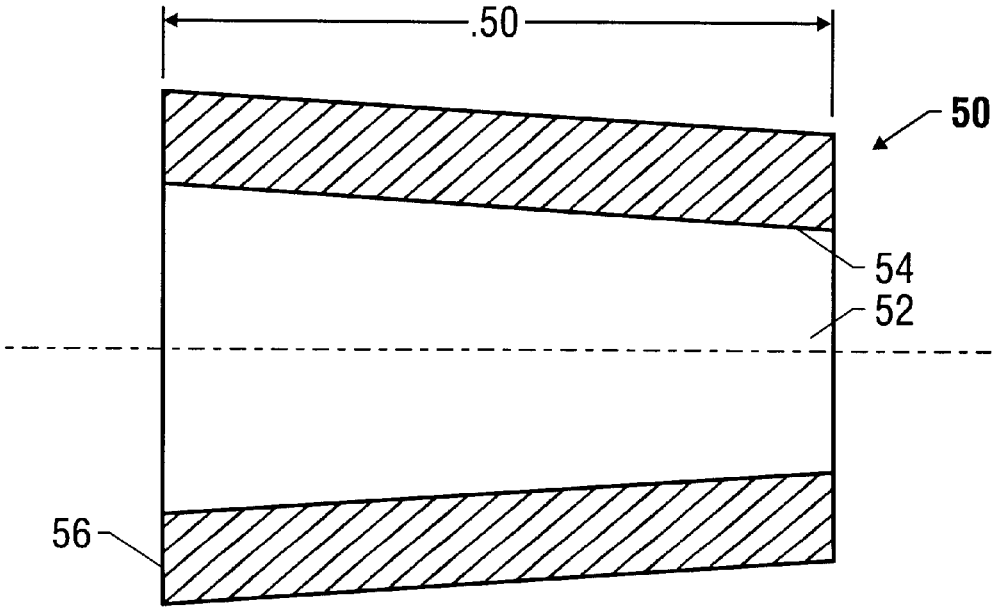
Figure 9:
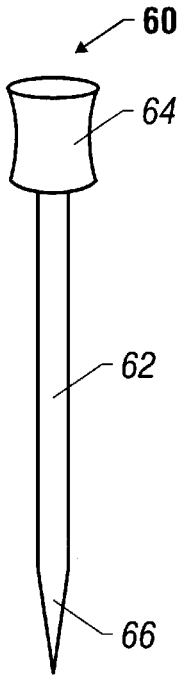
Figure 10:
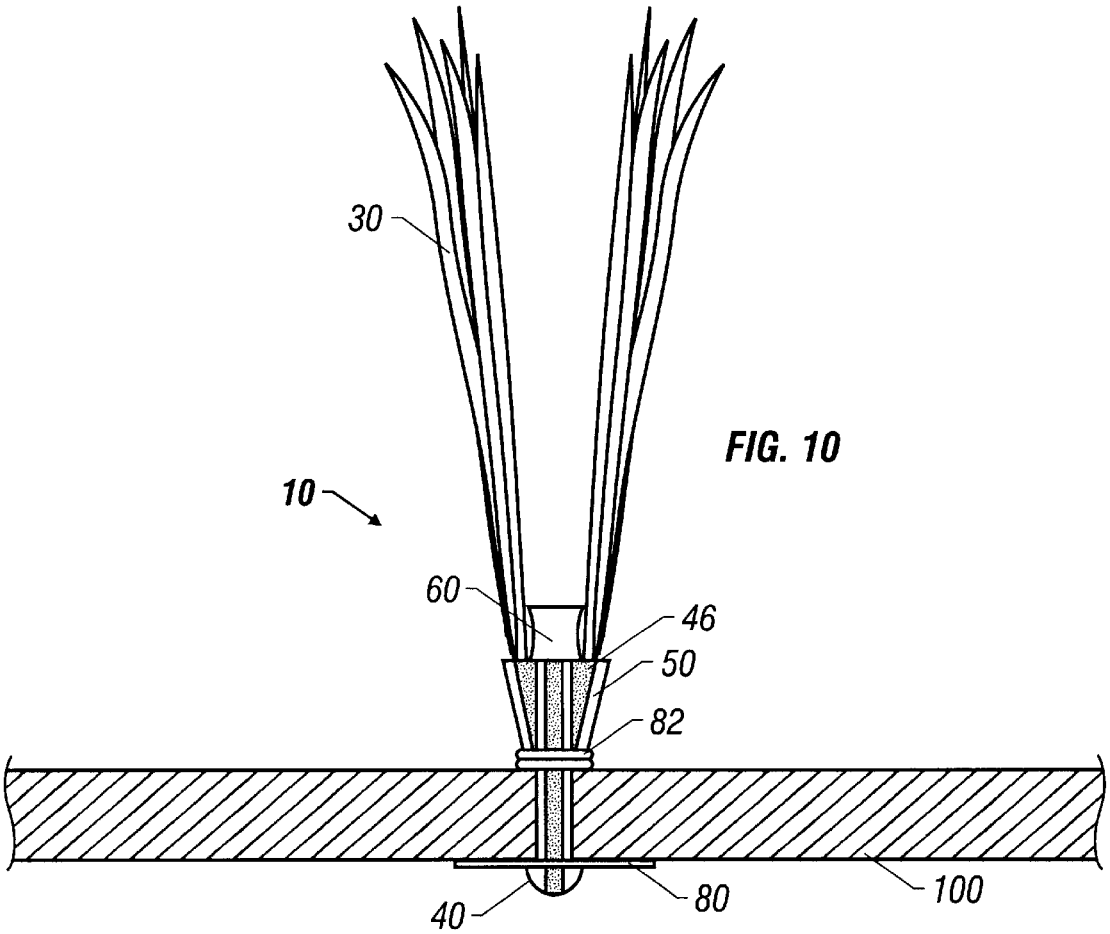
FIG. 10 is a sectional view schematic diagram of an assembled garnish installed in a base camouflage material.

The preferred tuft retaining anchor comprises the parts shown in FIGS. 7, 8A, 8B and 9, and assembled in FIG. 10. These parts are the inner retaining rivet 40, in FIG. 7, the retaining collar 50, in FIGS. 8A and 8B, and a lock pin 60, in FIG. 9. The inner retaining rivet 40 includes a shoulder portion 42 disposed on the inner side of the base camouflage material 100. The shoulder portion 42 is preferably of a shape and size so that it will only pass with difficulty in a slit or other opening through the base camouflage material 100 and will fit snugly against the base material thereafter. The shoulder 42 assists the tuft retaining anchor and garnish as a whole to maintain the mounted position even in the presence of externally applied, laterally directed, severe forces such as depicted in FIG. 12. The shoulder 42 may be augmented by a washer for increased snugness of fit with the base material 100. The retaining rivet 40 includes one or more longitudinally oriented sectional slots 44 to enable the outside diameter of the barb to be increased. The slots 44 form expandable ribs 46. The inner retaining rivet 40 includes a surface 48 against which the sheet with its strips or filaments is pressed, as described below. The inner retaining rivet 40 further includes a longitudinally centrally disposed cavity 45 (shown in phantom in FIG. 7) preferably extending through its entire length, into which the lock pin may be inserted. The inner retaining rivet 40 is preferably made of nylon.

The tuft retaining anchor further includes a retaining collar 50, shown in FIGS. 8A and 8B. The retaining collar 50 provides additional gripping force for maintaining the retaining rivet 40 in its assembled position on the base camouflage material 100, and is a substantial force retaining the cut strips in position on the mandrel. The retaining collar 50 includes a longitudinally centrally disposed opening 52, which is slightly tapered from top to bottom, so that the collar has a larger diameter opening end 56, and a smaller diameter opening end 58. During use, the larger diameter end 56 is preferably oriented toward the base camouflage material 100. The central opening 52 has a diameter and/or stretchability sufficient to receive the inner retaining rivet 40 and the coiled strip-like edge portion 28 of the sheet material. The retaining collar 50 is attached to the strip-like edge portion 28 of the sheet on the collar inner surface 54 by means of adhesive applied to the strip-like edge portion 28. The preferred adhesive is a transfer adhesive. The retaining collar 50 is preferably made of Delrin, and most preferably Delrin 100.

The tuft retaining anchor further includes a lock pin, shown in FIG. 9. Insertion of the lock pin 60 forces the expandable ribs 46 of the retaining rivet 40 outward against the retaining collar 50 when the tuft retaining anchor is fully assembled and attached to the base camouflage material 100. The lock pin 60 is generally cylindrical in shape, has a central, constant-diameter segment 62, and has an enlargement 64 at its upper end as shown in FIG. 9. The enlargement 64 serves as a handle or gripping surface for use in inserting or withdrawing the lock pin 60 into the remainder of the tuft retaining anchor, and may also serve as a stop surface to prevent over-insertion of the lock pin 60. The other end 66, at the lower end of the lock pin 60, is tapered down so as to permit the lock pin 60 to be forced into the centrally disposed opening 45, thereby serving to hold the mandrel parts together and the garnish in position on the base camouflage material 100. The lock pin 60 may have other shapes, but generally should approximately match.

Figure 7:
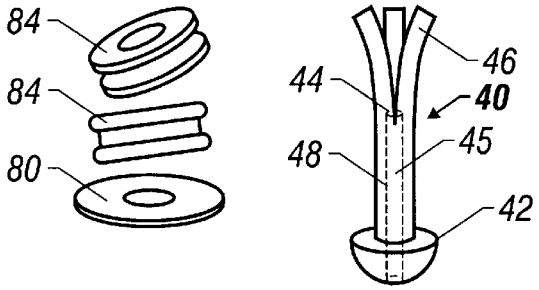
FIGS. 7, 8A, 8B and 9 are perspective view schematic diagrams of an inner barb, a lock collar, and a lock pin, respectively, of the tuft retaining anchor, according to the invention.

Further tuft retaining anchor parts are shown in FIG. 7, and include the washer 80 and an elastomeric grommet 84, both of which form a portion of and participate in attaching the garnish to the base camouflage material. The washer 80 is preferably a standard, steel washer, available off-the-shelf. The washer 80 is preferably at least about one-half inch in outer diameter, with an inner opening of a sufficient diameter to allow the retaining rivet 40 to be inserted, but not to allow the rivet shoulder portion 42 to pass. More preferably the diameter of the inner opening of the washer is only slightly larger than the outside diameter of the constant diameter rivet portion 48. The elastomeric grommet 84 is preferably made of a soft, pliable, resilient rubber-like material such as natural rubber, neoprene rubber, silicon rubber, or the like.

As best understood with reference to FIG. 10, to assemble the garnish 10, the inner retaining rivet 40 is first inserted through the washer 80, and then, from the underside of the base camouflage material 100, through the slit or "buttonhole" in the base camouflage material 100. At this point in the assembly process, the shoulder portion 42, together with the washer 80, prevent the retaining rivet 40 from being pulled through the base camouflage material 100. After this insertion, the base camouflage material 100 can be returned to its "working" position on the vehicle or equipment being camouflaged. Next, from the outer, upper side of the base camouflage material 100, the rubber grommet 84 is pressed down over the expandable ribs 46 of the inner retaining rivet 40. The grommet is followed by insertion of the retaining collar 50 over the expandable ribs 46 shown in FIG. 10. In the assembled tuft retaining anchor, the retaining collar 50 is pressed down so it is directly adjacent or in contact with the resilient rubber grommet 84, which in turn is adjacent or in direct contact with the base camouflage material 100. At the time the inner retaining rivet 40 receives the retaining collar 50, the collar already has the tuft in its central opening 52. Prior to the retaining rivet 40 receiving the retaining collar 50, the rolled tuft is held against the walls 54 of the central opening by the transfer adhesive applied thereto. After the retaining rivet 40 receives the retaining collar 50, the tuft is held in position by the pressure exerted by these parts, in addition to the transfer adhesive. The retaining collar 50 is attached with the end 56 having the larger diameter opening toward the base camouflage material 100. When the mandrel is assembled, the retaining rivet 40 passes into and partially through the retaining collar 50. The locking pin 60 is provided for additional security in retaining the garnish more securely in place on the base camouflage material 100. The locking pin 60 is inserted into the centrally disposed opening 45 in the retaining rivet 40. Insertion of the locking pin 60 forces the expandable ribs 46 of the retaining rivet 40 outward against the retaining collar 50, which increases the pressure on the strip-like edge portion 28, further assisting in retaining the tuft in position in the mandrel. Thus, the preferred garnish 10 is assembled and attached to the base camouflage material 100 in a single operation.

Figure 11:
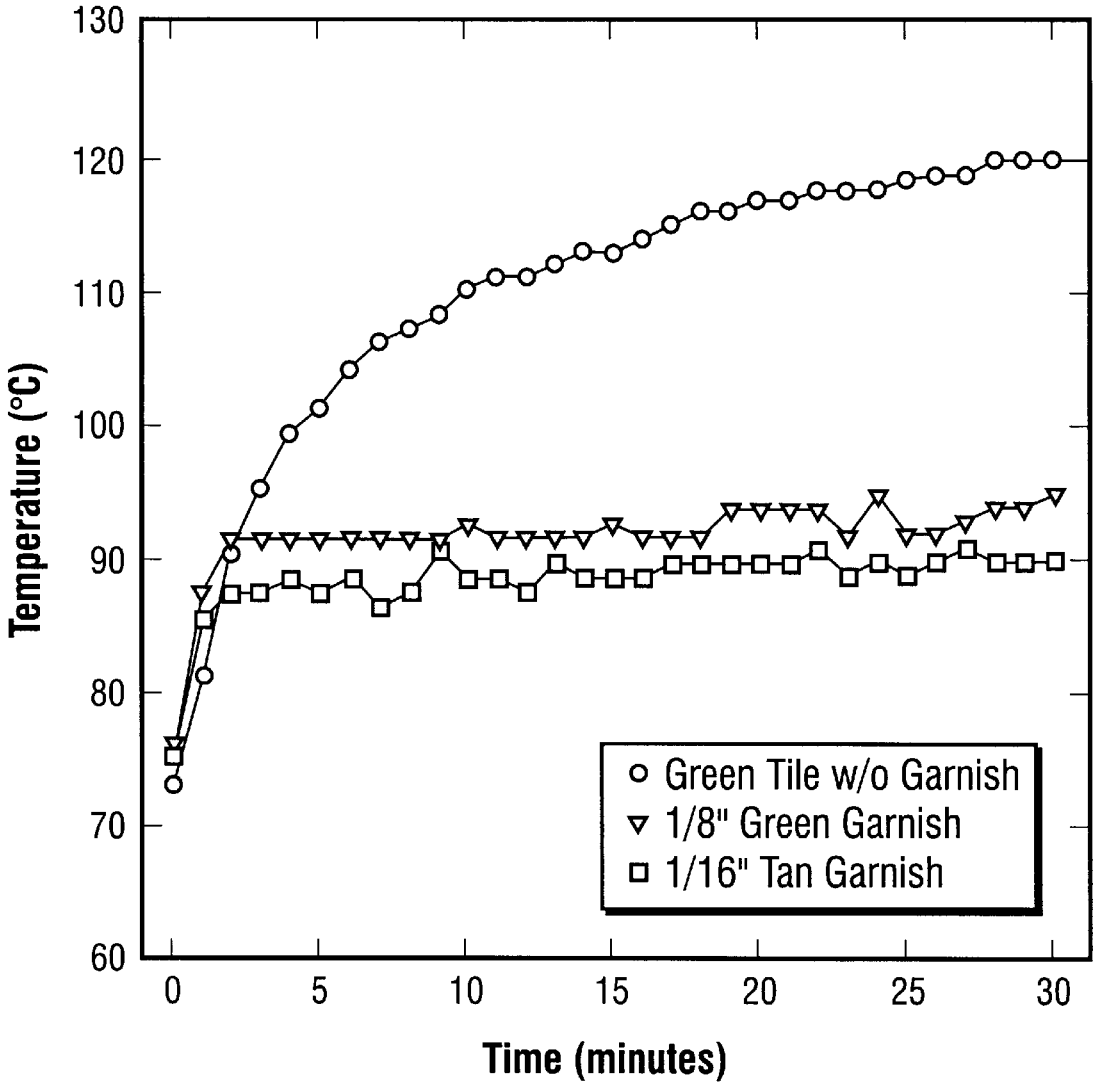
FIG. 11 is a graph of temperature versus time comparing the temperature increase in two embodiments of the present invention to the temperature increase of the base camouflage material without the garnishes of the present invention.

With reference now to FIG. 11, the unexpected benefits of the present invention are clearly demonstrated. FIG. 11 is a graph of the temperature increase experienced by three camouflaged structures, when all three are exposed under the same conditions to direct sunlight under conditions of little or no wind. As shown in FIG. 11, standard green tile base camouflage material, under these conditions, were heated from an ambient temperature of approximately 73° C. to a still increasing temperature of 120° C. during 30 minutes of exposure. By comparison, two embodiments of the present invention, one employing garnishes comprising ⅛" strips and the other employing garnishes comprising 1/16" strips, under the same conditions of exposure, were heated from initial temperatures of approximately 75° C. to a nearly constant temperature of approximately 90° C. during 30 minutes of exposure. This surprisingly smaller temperature increase results from the dissipation of heat through movement of the air layer adjacent the camouflaged object or test material. Had that heat not been dissipated by using the garnish of the present invention, a much greater increase in temperature would have been observed in this test, as was observed for camouflage material without the garnishes. Such an increase in temperature results in an increased and more easily detectable infrared signature. Thus, the unexpected benefits of the present invention are significant and clearly demonstrated by this example.

With reference now to FIG. 12, another feature of the present invention is shown. FIG. 12 shows the assembled, attached garnish of the invention when it is being struck or "wiped" by a passing obstacle. The resilient rubber grommet can be crushed on one side between the mandrel and the base camouflage material 100. The preferably nylon retaining rivet 40 is sufficiently flexible to withstand bending as the mandrel is pressed sideways. The overall flexibility of the garnish allows it to remain intact and operational even under harsh conditions, which allows the garnish to continue to protect the camouflaged vehicle or equipment during and after physically violent encounters with trees and other objects encountered during combat operations.

The novel camouflage material of the present invention comprises a base camouflage material having a garnish of tufted strips of low emissivity material, which acts by inducing a flow of air to maintain a low thermal signature even in still, calm air under bright sunshine. The present invention is particularly useful in the early morning hours. The present invention combines the low emissivity of air and the structure and composition of the garnish to induce air movement over and around the garnish. The present invention thus removes heat from, and thereby minimizes any temperature rise and increased infrared signature in, the base camouflage material. The garnish acts as an efficient air pump, due to the multitude of surfaces provided by the strips or filaments of the tufts, each of which absorbs a small amount of heat, and induces a movement of air thereabout. The height of the surface and high porosity allow a thick boundary layer of air around the vehicle to be induced into movement. The temperature increase of this large mass of air effectively carries away the heat, lowering the energy and reducing the infrared signature of the camouflaged object. The combined effect of the multitude of surfaces is to induce a flow of air of sufficient magnitude to remove the heat accumulated by the camouflaged object and the camouflage material in the bright sunshine, even when no wind or other air movement is available.

Having described the invention above, various modifications of the techniques, procedures, material and equipment will be apparent to those in the art. It is intended that all such variations within the scope and spirit of the appended claims be embraced thereby.

What is claimed is:

1. A garnish for a base camouflage material for avoiding infrared detection of a body, comprising:

a tuft retaining anchor including a shoulder portion for retaining the garnish in attachment with the base camouflage material, the tuft retaining anchor further including a retaining rivet and a retaining collar, a tuft of strips, wherein the tuft is made from a sheet of garnish material having a longitudinal axis and a plurality of slits substantially perpendicular to the longitudinal axis, the slits forming strips of garnish material, the sheet having an adhesive layer along a strip edge portion, the slits extending across the sheet to the strip edge portion, wherein the tuft is formed when the sheet is coiled along the uncut strip portion, and the coiled strip portion is disposed between the retaining rivet and the retaining collar and is at least partially retained in coiled condition by the adhesive layer.

2. A garnish for a camouflage material as claimed in claim 1, wherein each of the strips has substantially the same length.

3. A garnish for a camouflage material as claimed in claim 1, wherein the strips have lengths defining an angled line.

4. A garnish for a camouflage material as claimed in claim 1, wherein the strips have lengths defining a parabolic curve.

5. A garnish for a camouflage material as claimed in claim 1, wherein the strips have variable lengths.

6. A garnish for a camouflage material as claimed in claim 1, wherein the tuft retaining anchor comprises a retaining collar, a lock pin, and an inner retaining rivet, and the lock pin locks the inner retaining rivet in locking position in the retaining collar.

7. A garnish for a camouflage material as claimed in claim 6, wherein the lock pin is removable from the inner retaining rivet to allow release from the locking position.

8. A garnish for a camouflage material as claimed in claim 1, wherein the shoulder portion passes through a washer for attaching the garnish to the base camouflage material.

9. A garnish for a camouflage material as claimed in claim 1, wherein the base camouflage material is an artificial surface mimicking the appearance of natural covering material.

10. A garnish for a camouflage material as claimed in claim 1, wherein the tuft retaining anchor further comprises a locking pin.

11. A garnish for a camouflage material as claimed in claim 10, wherein the locking pin is inserted into a centrally disposed opening in the retaining rivet.

12. A garnish for a camouflage material as claimed in claim 1, wherein the tuft retaining anchor further comprises an elastomeric washer.

13. A garnish for a camouflage material as claimed in claim 12, wherein the elastomeric washer is disposed between the retaining collar and the base material.

14. A garnish for a camouflage material as claimed in claim 1, wherein the garnish material comprises materials having different visual and/or infrared colors to allow matching with different background colors.

15. A camouflage material for avoiding detection of an underlying body by an infrared detection device, comprising:

an underlying layer of a base camouflage material having a plurality of openings therethrough;

a plurality of garnishes, each garnish comprising a tuft retaining anchor including a shoulder portion for retaining the mandrel in attachment to the base camouflage material, a retaining rivet and a retaining collar, and further comprising a tuft of strips, wherein the tuft is made from a sheet of garnish material having a longitudinal axis and a plurality of slits substantially perpendicular to the longitudinal axis, the slits forming strips of garnish material, the sheet having an adhesive layer along a strip edge portion, the slits extending across the sheet to the strip edge portion, wherein the tuft is formed when the sheet is coiled along the strip edge portion and the coiled strip edge portion is disposed between the retaining rivet and the retaining collar, and the sheet is at least partially retained in coiled condition by the adhesive layer; and each of the plurality of garnishes is attached to the underlying layer by means of the shoulder portion.

16. A garnish for a camouflage material as claimed in claim 15, wherein each of the strips has substantially the same length.

17. A garnish for a camouflage material as claimed in claim 15, wherein the strips have lengths defining an angled line.

18. A garnish for a camouflage material as claimed in claim 15, wherein the strips have lengths defining a parabolic curve.

19. A garnish for a camouflage material as claimed in claim 15, wherein the strips have variable lengths.

20. A garnish for a camouflage material as claimed in claim 15, wherein the tuft retaining anchor comprises a retaining collar, a lock pin, and an inner retaining rivet, and the lock pin locks the inner retaining rivet in locking position in the retaining collar.

21. A garnish for a camouflage material as claimed in claim 20, wherein the lock pin is removable from the inner retaining rivet to allow release from the locking position.

22. A garnish for a camouflage material as claimed in claim 15, wherein the shoulder portion passes through a washer for attaching the garnish to the base camouflage material.

23. A garnish for a camouflage material as claimed in claim 15, wherein the base camouflage material is an artificial surface mimicking the appearance of natural covering material.

24. A garnish for a camouflage material as claimed in claim 15, wherein the tuft retaining anchor further comprises a locking pin.

25. A garnish for a camouflage material as claimed in claim 24, wherein the locking pin is inserted into a centrally disposed opening in the retaining rivet.

26. A garnish for a camouflage material as claimed in claim 15, wherein the tuft retaining anchor further comprises an elastomeric washer.

27. A garnish for a camouflage material as claimed in claim 26, wherein the elastomeric washer is disposed between the retaining collar and the base material.

28. A garnish for a camouflage material as claimed in claim 15, wherein the garnish material comprises materials having different visual and/or infrared colors to allow matching with different background colors.

* * * * *